US006401310B1

(12) United States Patent
Warner et al.

(10) Patent No.: US 6,401,310 B1
(45) Date of Patent: Jun. 11, 2002

(54) SNOWSHOE BUCKLE

(76) Inventors: Charles Bentley Warner, 725-A Ashbury St., San Francisco, CA (US) 94117; Daniel T. Emerson, 1269 Grandview Dr., Berkeley, CA (US) 94705; Nathan J. Messmer, 2219 Bryant St., San Francisco, CA (US) 94110

( * ) Notice: Subject to any disclaimer, the term of this patent is extended or adjusted under 35 U.S.C. 154(b) by 0 days.

(21) Appl. No.: 09/777,009

(22) Filed: Feb. 2, 2001

(51) Int. Cl.[7] ..... A44B 11/20; A63C 9/14; A43B 5/18

(52) U.S. Cl. ..... 24/179; 24/265 BC; 36/122; D11/216

(58) Field of Search ..... 24/170, 171, 178, 24/179, 68 CD, 265 BC, 265 EC, 188, 191, 327; 36/123, 122, 50.5; D11/216, 218

(56) References Cited

U.S. PATENT DOCUMENTS 1,257,028 A * 2/1918 Ryther ..... 24/170
4,631,784 A * 12/1986 Fildan ..... 24/170
4,843,688 A * 7/1989 Ikeda ..... 24/170
5,431,365 A * 7/1995 Hopkins ..... 248/683
5,440,827 A 8/1995 Klebahn
5,687,491 A 11/1997 Klebahn
5,699,630 A 12/1997 Klebahn
5,732,448 A * 3/1998 Shields et al. ..... 24/180
5,901,471 A 5/1999 Warner
5,918,387 A 7/1999 Emerson
6,224,070 B1 * 5/2001 Carpenter et al. ..... 280/14.2

OTHER PUBLICATIONS

Cargo Restraint Hardware brochure of DJ Associates, Inc. Jun. 15, 1997.

* cited by examiner

*Primary Examiner*—Robert J. Sandy
(74) *Attorney, Agent, or Firm*—Thomas M. Freiburger

(57) ABSTRACT

A strap buckle, particularly for use in a snowshoe binding, operates somewhat as a cam lock buckle but instead of exhibiting pinching force on the strap which increases with increased back-pulling force, the buckle's spring loaded lever engages a nipple or protrusion more deeply into a hole in the hole-punched strap as back-pulling force increases. The buckle lever has a strong downward bend, so that a front end of the lever tucks the strap tail against the user's boot and aids in the releasing of the lever from the strap.

4 Claims, 3 Drawing Sheets

SNOWSHOE BUCKLE

BACKGROUND OF THE INVENTION

This invention concerns snowshoes and the manner in which snowshoes are secured to boots of users. Specifically the invention relates to use of a more effective, efficient and lower friction buckle used with a hole-punched rubbery strap of a snowshoe binding, as well as to a special design of buckle for general uses.

Snowshoes have some form of harness assembly for securely engaging a user's boot, normally also including a strap to extend around the heel. Examples of snowshoe harness assemblies are shown in U.S. Pat. Nos. 5,440,827, 5,687,491, 5,699,630, 5,901,471 and copending application Ser. No. 10,199, filed Jan. 21, 1998 as well as copending application Ser. No. 494,324, filed Jan. 28, 2000.

A number of snowshoes have webbing type straps in the harness assemblies, formed of woven nylon, polyester or other synthetic fibers, often used with ladder lock type buckles to engage with the webbing strap to tighten the harness over a boot. Ladder lock buckles are based on a type of frictional engagement of the strap. Other buckles or latches have also been used, such as ratcheting buckles where movement of a lever in one direction advances the toothed strap by one tooth each stroke, and release is effected by an extreme movement of the lever. Such straps are relatively rigid. The latches are not as quick to use as ladder lock buckles, but greater leverage can be achieved in tensioning the harness.

Cam lock buckles are well known in contexts other than snowshoes, and in copending application Ser. No. 494,324 referenced above, a cam lock buckle of particular construction is described as used to secure the webbing straps on a snowshoe. The cam lock buckles have a generally nautilus-shaped hub, with varying radius and teeth located at the area of greatest radius. Typically the strap is doubled back over the same bar toward which the spring lever is biased, causing relatively high friction at this doubling over location, friction to be overcome when the strap is to be tightened. A positive grip on the strap is provided by the nautilus-shaped hub and the teeth, such that the greater the back-pulling force on the tensioned portion of the strap, the more the teeth engage into the strap and thus the more positive becomes the locking engagement.

Several snowshoes have used rubbery straps with a series of holes along the middle of the strap. These hole-punched straps (not necessarily formed by punching) are typically used with a buckle comprising a roughly rectangular frame having a fixed prong to engage in an appropriate strap hole when tightened.

It is an object of the invention described below to improve the ease of use and positive engagement with such a hole-punched strap on a snowshoe, through provision of an improved buckle for such a strap.

SUMMARY OF THE INVENTION

In this invention a snowshoe has a binding with straps, at least one of which is of the type with a series of holes down the middle of the strap. The strap or straps are fitted with at least one buckle which has a spring-loaded lever with a hub positioned to engage the strap between the hub and a wall of the buckle frame as the strap passes through the buckle in a looped back configuration. The hub of the buckle lever has a nipple or protrusion which is of a size to fit in any of the holes along the strap. The configuration of this buckle provides for ease of use, with low-friction pulling of the strap's tail for tightening and with positive engagement of the strap, via the holes. This positive engagement is increased, in a manner similar to that of a cam lock buckle, as back-pulling on the tensioned part of the strap is increased. The increased back-pulling tension pulls against the nipple or protrusion in a manner that causes the spring loaded lever to close more tightly (in the same direction as spring force), thus further rotating the hub and lever and causing the protrusion to bite more deeply into the strap hole.

In a preferred embodiment of the lever, the outer end of the lever, which can be engaged by the thumb or finger of a user (but which action is usually not needed) has a downward bend that engages the strap tail and holds it down against the user's boot, while also assisting in releasing the lever from the strap by reducing the angle at which the user needs to pull up on the strap to remove the nipple or protrusion from the strap holes.

It is thus a primary object of the invention to make simpler and easier the tightening and release of a tension strap passing through a buckle, and particularly in the context of snowshoes. This and other objects, advantages and features of the invention will be apparent from the following description of a preferred embodiment, considered along with the accompanying drawings.

DESCRIPTION OF PREFERRED EMBODIMENTS

Figure 1:
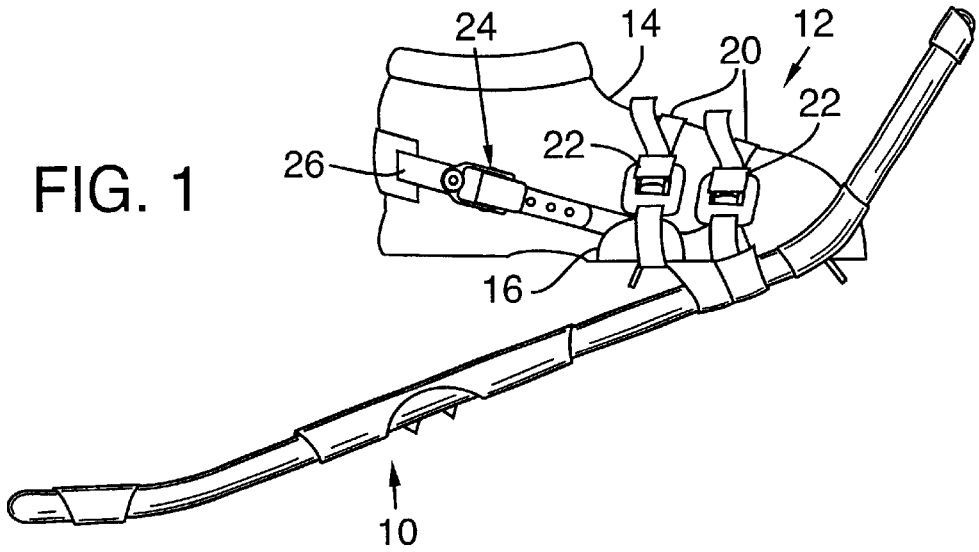
FIG. 1 is a schematic side elevation view showing the snowshoe with several straps securing the user's boot, including a heel strap with the buckle of the invention.

FIG. 1 shows a snowshoe 10 of a general type with which the invention, in a preferred embodiment, is concerned. The snowshoe 10 has a harness assembly 12 for securing a user's boot 14 to the snowshoe, the harness including left and right harness web portions 16 which are to be drawn toward one another for engaging the boot. Webbing straps 20 may be used in the boot toe harness assembly, such as described in the above referenced copending application, with an appropriate webbing strap buckle 22. The buckle and strap assembly of the invention could be used on the toe harness assembly if desired, but in FIG. 1 the buckle 24 of the invention is shown used in engagement with a heel strap 26 secured around the heel of the user's boot.

Figure 2:
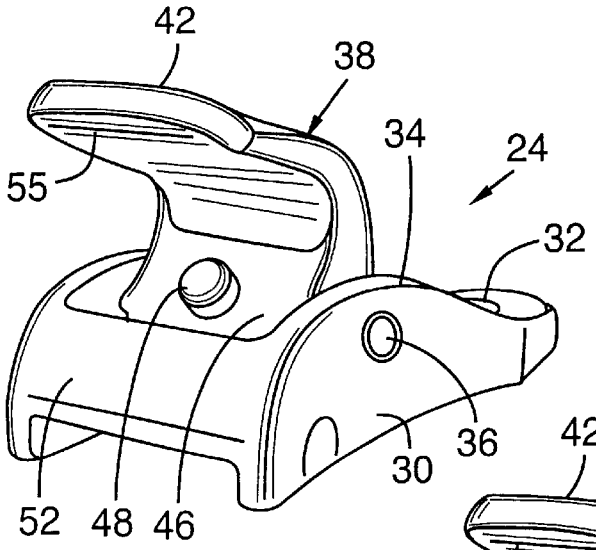
FIGS. 2 and 3 are perspective views showing the buckle, without a strap and with a strap.
Figure 3:
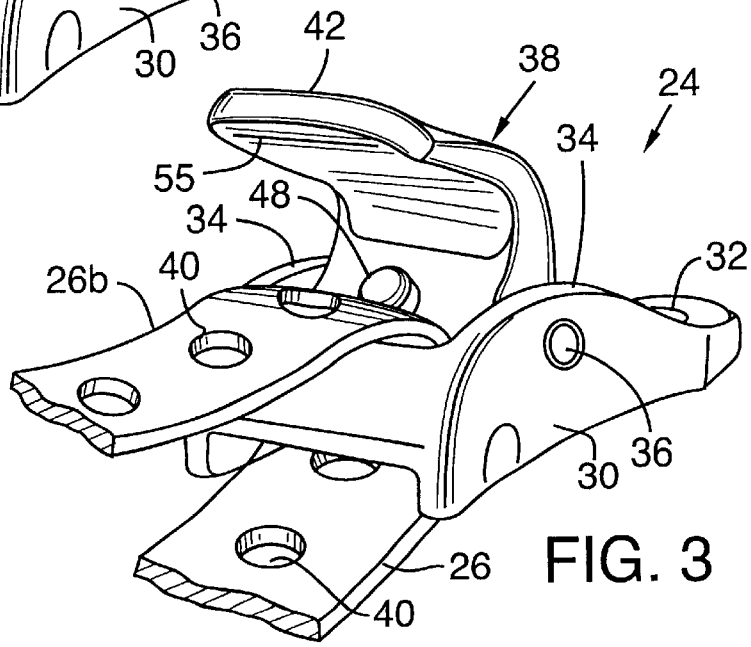
Figure 4:
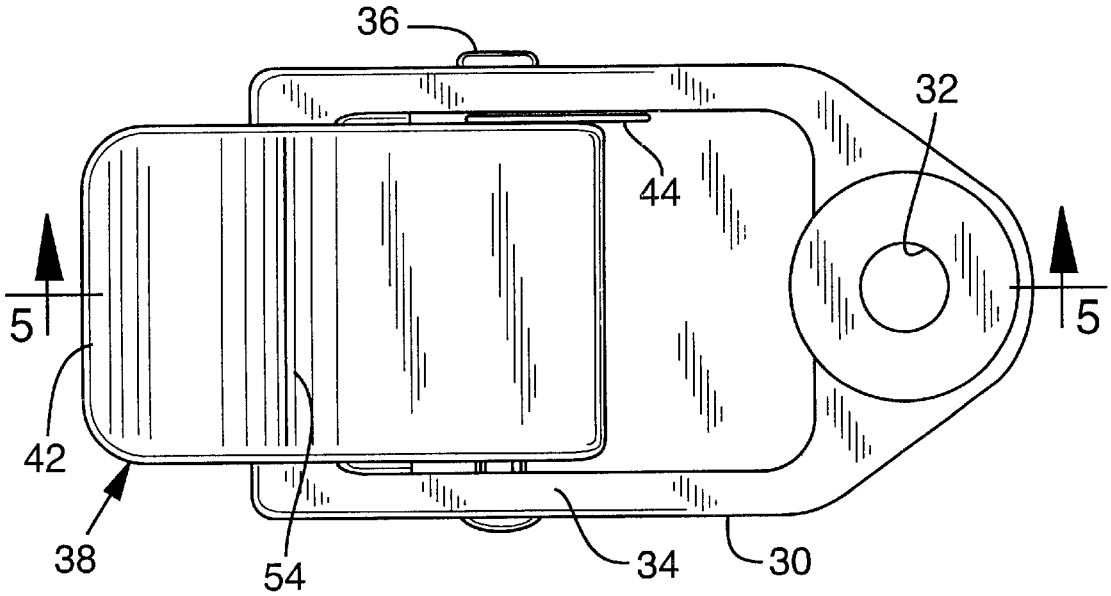
FIG. 4 is a plan view of the buckle.
Figure 5:
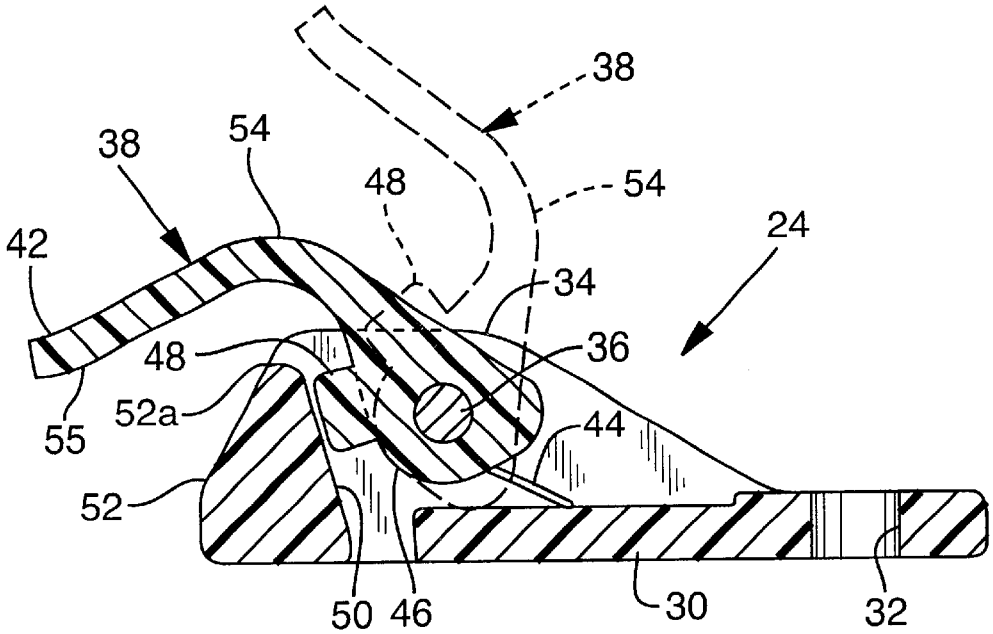
FIG. 5 is a sectional view of the buckle, showing a closed position of the lever and indicating in dashed lines an open position.
Figure 6:
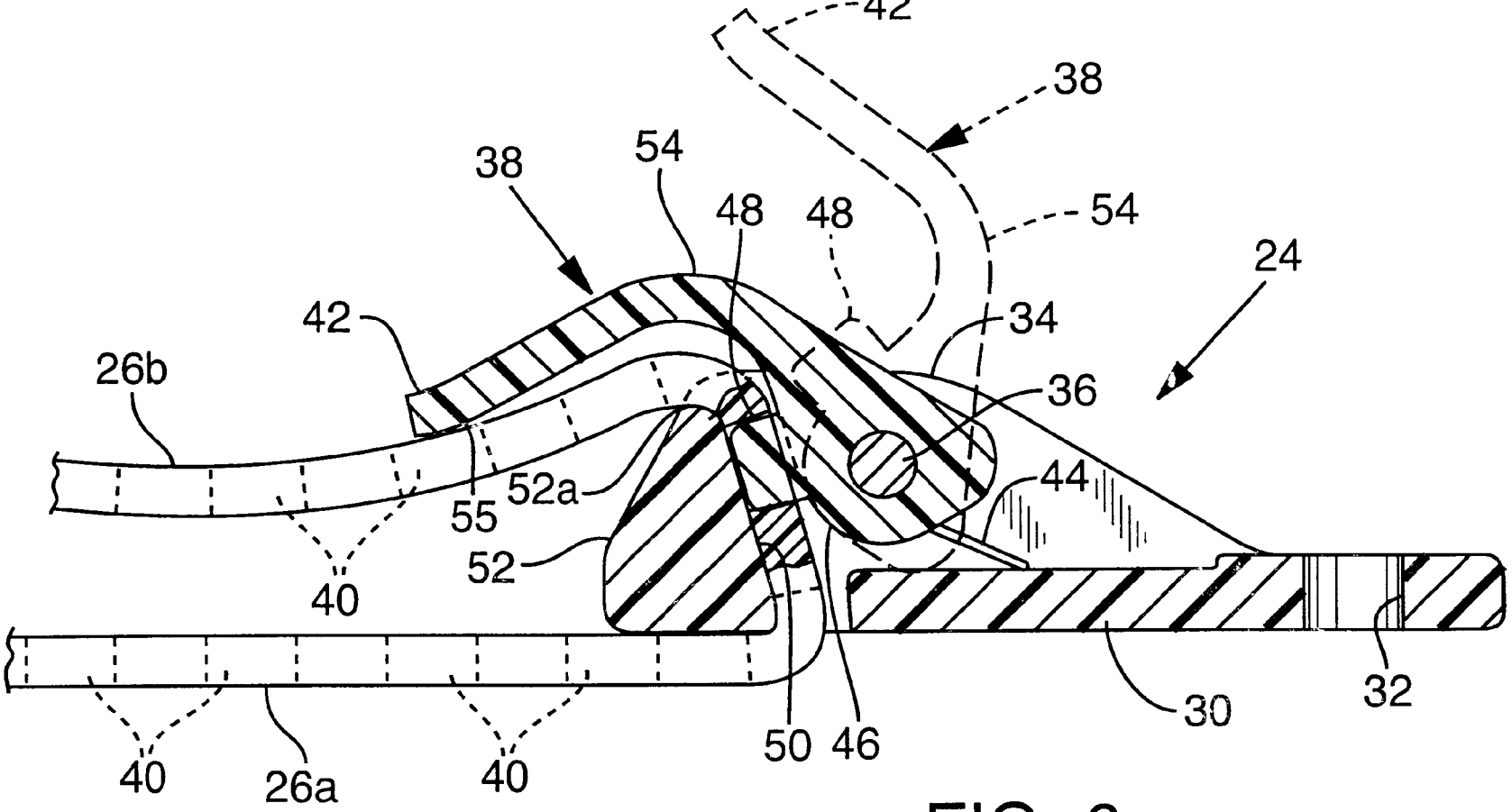
FIG. 6 is a schematic section view in elevation similar to FIG. 5, and showing a strap engaged in the buckle.

FIGS. 2 and 3 show the buckle 24 somewhat schematically in perspective. Reference is also made to FIGS. 4, 5 and 6. The buckle 24 has a base 30 comprising a molded plastic frame, with a reinforced connection eye hole 32 at a back end. A pair of side flanges 34 support a pivot shaft 36 on an axis for a lever 38 configured to engage and lock with a hole-punched strap 26. These straps, already in use in snowshoes, particularly as a heel strap, typically are formed of urethane and may have holes 40 about 5 mm in diameter, at spacings of about 1 cm or greater. The strap may be about 2 cm wide and affords some stretch, but is very strong. Its holes may be formed by a process other than punching, although called hole-punched herein.

The buckle lever 38 is biased in the counterclockwise direction as viewed in FIGS. 2, 3, 5 and 6, toward a closure position with a protruding end 42 of the lever downward (as shown in FIGS. 4 and 6). The lever 38 is biased in this direction by a strong coil torsion spring, a tail 44 of which is visible in FIG. 4. The spring may have a force, for example, of about one inch-pound or more when opened approximately as shown FIG. 2, slightly less when closed as shown in FIGS. 5 and 6.

The lever 38 has a hub portion 46 through which the rotational axis or shaft 36 passes, this hub being enlarged in size as shown particularly in FIG. 5. The hub carries a nipple or protrusion 48 of a diameter that will fit fairly closely within any of the holes 40 in the strap 26. Thus, the spring tension tends strongly to engage the nipple 48 in a hole, as a hole is encountered in the strap, and, is shown diagrammatically in FIG. 6, when back-pulling tension is exerted on the tensioned portion 26*a* of the strap, this tension tends to pull the strap downwardly through the buckle 24 and downwardly against the nipple or protrusion 48, thus tending further to pull the lever 38 in a counterclockwise direction of rotation. The buckle thus acts somewhat as a cam lock buckle, except that the hub does not utilize a nautilus shape to pinch the strap but rather a protrusion to positively engage in a hole of the strap. As best seen in FIG. 5, the buckle has an internal wall 50 formed on a front cross member or bar 52, which the lever protrusion 48 approaches but preferably does not contact. The lever 38 is shown in a slightly uplifted position in FIG. 5; its stop position, without a strap, preferably is defined by engagement of the lever's underside against the top edge 52*a* of the front cross member.

FIGS. 2 and 3 show a raised, back-rotated position of the lever 38, shown also in dashed lines in FIGS. 5 and 6. This position is for illustration only, and might be realized if the user's thumb or finger pulls back on the lever (against the spring force). However, in actual use this usually need not be done, unless a strap is first being fed into and through the buckle.

The buckle lever 38 has its overhanging front end at an angled position relative to the remainder of the buckle, due to a bend or curve 54 in the lever. This bend, preferably located just above the cross member 52, forms a change in direction of the lever of roughly about 60°, or in the range of about 45° to 70°. It has several purposes. The bend makes a compact, tucked down configuration as generally shown in FIG. 6, so that the buckle lever is not accidently pulled up by unintentional snagging. It also keeps the loose strap tail 26*b* down against the user's shoe, so that the strap is not inadvertently snagged. Most importantly, however, the bent down forward end 42 of the lever enables the user to tighten the strap and to release the buckle from the strap with only a small angle of upward pulling on the strap tail 26*b*. As can be envisioned from FIG. 6, this strap tail 26*b* can be raised up by only a small amount, until the forward lever portion 42 is approximately parallel to the buckle's base 30, and this will rotate the nipple or protrusion 48 clockwise upwardly enough to release the nipple from the strap hole 40. If the lever were straight, without the bend 54, the angle of required strap manipulation would be much greater.

The terms "up" and "down", etc. as used in this description refer to the buckle and components as seen in the drawings, for convenient reference, and are not intended as limiting.

The drawings also show that the lever end 42 preferably has a slight reverse curve 55 at its tip. This is to help the strap 26 slide under the lever end smoothly when desired, and also to assist a user in slipping a thumb or finger under the lever when desired.

It should be understood that the nipple 48 could be of a shape other than round, correlated to the shape of holes or deep recesses in the strap. There could be two nipples or bumps correlated to two rows of holes or recesses on a strap. The nipples 48 could be lateral ridges to fit in slots of the strap.

We claim:

1. A buckle for use in tightening a strap in a configuration wherein the strap doubles back at the buckle so that a tail end of the strap is pulled through the buckle to tighten the strap, comprising:

a buckle frame with a first end adapted for engagement with a hole-punched strap to pass through the buckle and double back, and a second end adapted for connection to an item to be pulled tight, a hole-punched strap having a tension portion extending in a direction opposite said second end and passing through the buckle frame and extending out of the buckle frame in doubled-back fashion such that a tail of the strap is positioned to be pulled by a user for tightening the tension portion of the strap, the frame having a cross member over which the strap is doubled, near the first end of the frame, the buckle having a spring loaded, pivoted lever with a hub on a pivot axis transverse to the length of the strap, and a protrusion on the hub positioned and sized to engage against the strap and to enter a selected hole of the hole-punched strap, and the cross member providing an internal wall spaced from the hub of the lever such that the strap passes between the internal wall and the hub with the protrusion, and the lever being spring loaded in a direction of rotation toward a closed position in which the protrusion is downward and moved closest toward the tension portion of the strap, and the protrusion being positioned such that a deliberate counter rotation of the lever, against the spring biasing so as to and move the protrusion upwardly, will release the protrusion from a hole in the strap and thus release tension in the tension portion of the strap, whereby, when the strap is engaged on the buckle and the lever is approximately in the closed position, an increase in back pulling force in the tension portion of the strap tends to draw the lever more toward the closed position, pivoting the lever downwardly and more completely engaging the protrusion in the strap hole and thus positively gripping the strap in the buckle and preventing slipping.

2. The buckle of claim 1, wherein the lever includes a forward end which bends downwardly from the remainder of the lever, through a bend which is located approximately above the cross member of the buckle frame.

3. The buckle of claim 2, wherein the lever bends through an angle of about 45° to 70°.

4. The buckle of claim 1, in combination with a snowshoe, the strap being positioned to wrap around a user's boot for securing the boot to the snowshoe.

* * * * *